US011073354B1

(12) United States Patent
Peng

(10) Patent No.: US 11,073,354 B1
(45) Date of Patent: Jul. 27, 2021

(54) GUN ELEVATION ROTOR JOINT

(71) Applicant: Timothy Li Ming Peng, Alexandria, VA (US)

(72) Inventor: Timothy Li Ming Peng, Alexandria, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 16/925,134

(22) Filed: Jul. 9, 2020

(51) Int. Cl.
*F41A 27/08* (2006.01)
*F41A 27/24* (2006.01)

(52) U.S. Cl.
CPC ..... *F41A 27/08* (2013.01); *F41A 27/24* (2013.01)

(58) Field of Classification Search
CPC ..... F41A 27/08; F41A 27/10; F41A 27/12; F41A 27/14; F41A 27/16; F41A 27/18; F41A 27/20; F41A 27/24
USPC ..... 89/37.07
See application file for complete search history.

(56) References Cited

U.S. PATENT DOCUMENTS 472,244 A * 4/1892 Holmstrom et al. ..... F41A 5/32 89/4.1
614,042 A * 11/1898 Vickers et al. ..... F41A 27/08 89/37.07
3,776,049 A * 12/1973 Emery ..... H01H 13/60 74/110
3,868,617 A * 2/1975 Dragon ..... H01H 85/43 337/203
3,882,290 A * 5/1975 Duncan ..... H01H 21/285 200/47
4,599,933 A * 7/1986 Stoner ..... F41A 25/20 89/25
4,690,032 A * 9/1987 Stoner ..... F41A 9/45 89/199
4,913,361 A * 4/1990 Reynolds ..... B02C 19/0056 241/259
5,771,980 A * 6/1998 Mork ..... A01B 31/00 172/445.1
2003/0154753 A1* 8/2003 Dimig ..... E05B 29/00 70/495
2005/0200150 A1* 9/2005 Austin ..... B62D 33/0273 296/50
2006/0162540 A1* 7/2006 Meintjes ..... F41A 27/08 89/37.07

FOREIGN PATENT DOCUMENTS

CH 651657 A5 * 9/1985 ..... F41A 27/10

* cited by examiner

*Primary Examiner* — John Cooper
(74) *Attorney, Agent, or Firm* — Gerhard W. Thielman

(57) ABSTRACT

An attachment mechanism is provided for connecting a trunnion shaft to a pivoting platform. The mechanism includes a bracket, a block, a polygonal terminus attached to the trunnion shaft, a pair of bolts and fasteners. The bracket has a center recess and flanking surfaces parallel to the pivoting platform. The block has a cutout notch. The polygonal terminus inserts into a gap formed between the recess and the notch. The pair of bolts extends through the bracket and the terminus, and inserts into the block. The plurality of fasteners attaches the bracket at the facing surfaces to the pivoting platform.

5 Claims, 3 Drawing Sheets

GUN ELEVATION ROTOR JOINT

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to gun mounts. In particular, the invention relates to an attachment mechanism for an elevation trunnion used to support an artillery piece.

The United States Navy employs five-inch (0.127 m) bore diameter lightweight guns, referred to as 5"/54 caliber Mark 45, aboard various combat vessels, including the Arleigh Burke-class guided missile destroyers. These Mk 45 guns attach to the ship on mounts that pivot in azimuth and elevation so as to engage targets by firing projectiles. The mounts include gimbal mechanisms to enable pivoting in two axes. The Mod 2 version has a mass of 2.169-104 kg and a length of 8.992 m with a barrel length of 6.858 m.

SUMMARY

Conventional gun attachment to trunnion devices yield disadvantages addressed by various exemplary embodiments of the present invention. In particular, various exemplary embodiments provide an attachment mechanism for connecting a trunnion shaft to a pivoting platform. The mechanism includes a bracket, a block, a polygonal terminus attached to the trunnion shaft, a pair of bolts and fasteners.

In exemplary embodiments, the bracket has a center recess and flanking surfaces parallel to the pivoting platform. The block has a cutout notch. The polygonal terminus inserts into a gap formed between the recess and the notch. The pair of bolts extends through the bracket and the terminus, and inserts into the block. The plurality of fasteners attaches the bracket at the facing surfaces to the pivoting platform.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced.

These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in inches (in) or meters (m), mass in kilograms (kg), time in seconds (s) and angles in degrees (°). Supplemental measures can be derived from these, such as density in grams-per-cubic-centimeters ($g/cm^3$), moment of inertia in gram-square-centimeters ($kg\text{-}m^2$) and the like.

Figure 1:
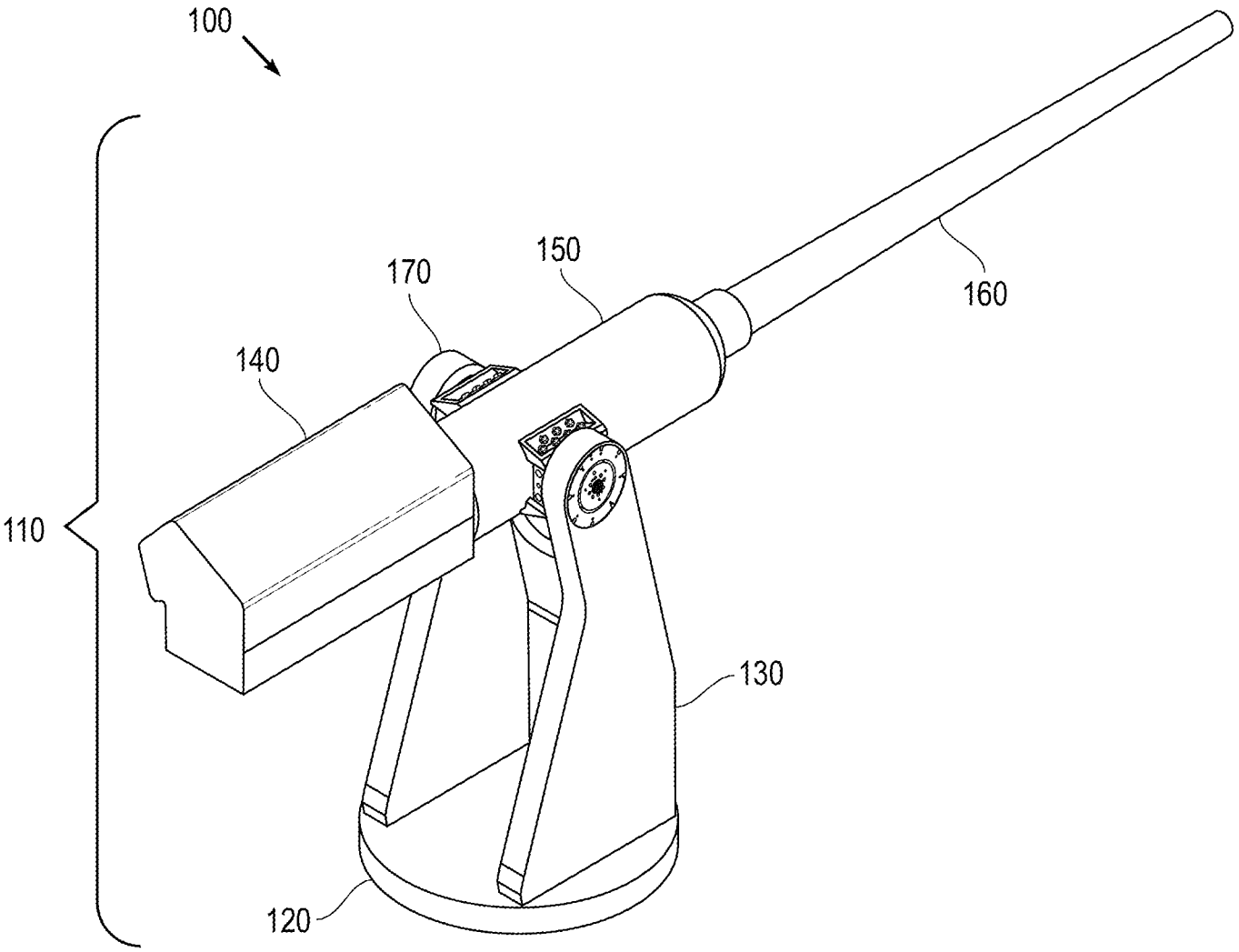
FIG. 1 is an isometric view of a naval gun system.

FIG. 1 shows an isometric view 100 of a shipboard gun mechanism 110. A base 120 is disposed on a shipboard platform, designed to pivot in azimuth. A carriage 130 comprising a pair of yoke arms is disposed on the base 120. An equipment breech 140 is disposed at the proximal end of the gun chamber 150, while a barrel 160 is disposed at the distal end. A pair of rotor assemblies 170 is disposed on the respective yoke arms of the carriage 130 to pivot vertically and thereby adjust elevation of the barrel 160.

Figure 2:
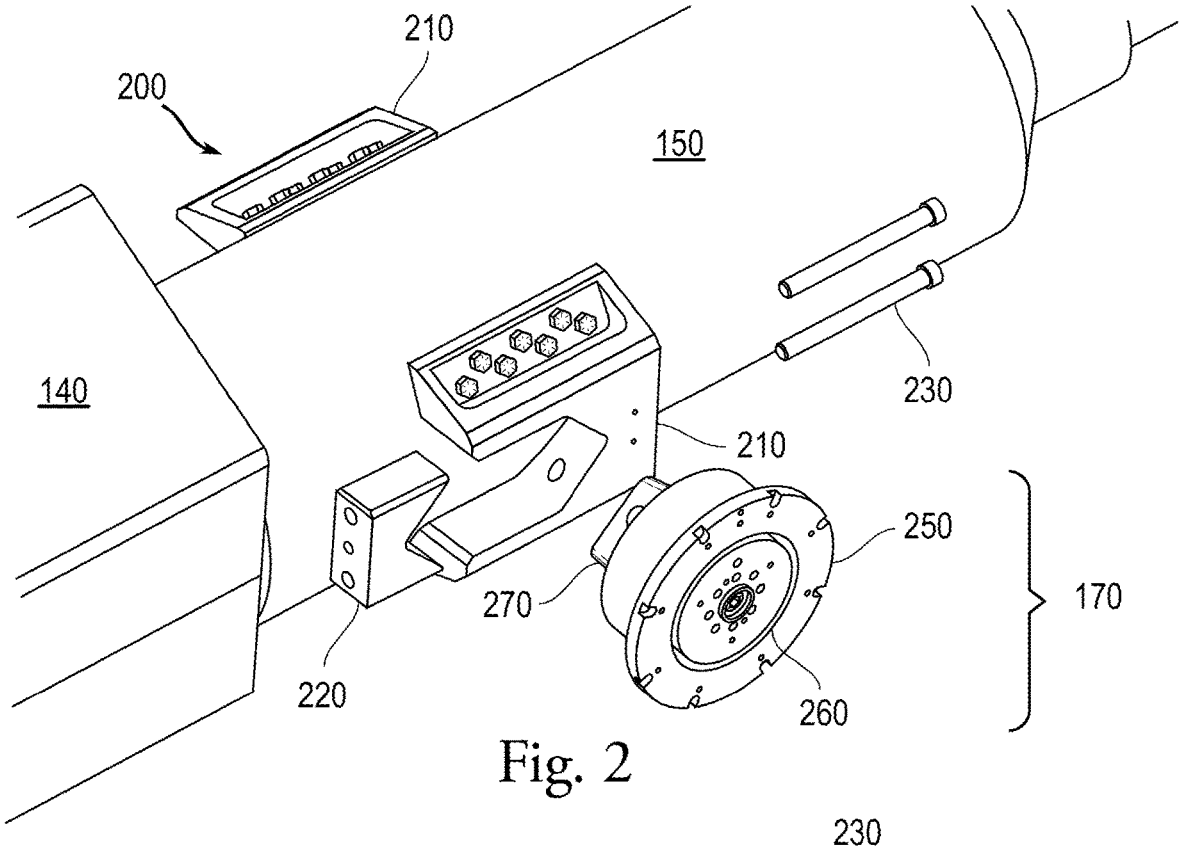
FIG. 2 is an isometric exploded view of exemplary mating components.

FIG. 2 shows an isometric exploded view 200 of the rotor assembly 170 and associated attachment mechanisms for the mating assembly or joint, and with the yoke arms of the carriage 130 omitted. A clevis bracket 210 abuts against the gun chamber 150 on the starboard side, accompanied by a tang block 220. The bracket 210 and block 220 connect together by a pair of bolts 230. The rotor assembly 170 includes an annular rim 250 that attaches securely to the carriage 130, a rotor shaft 260 that enables the gun chamber 150 to pivot, and a polygonal shaft terminus 270.

The bracket 210 and block 220 wedge the terminus 270 there-between for enabling the shaft 260 of the rotor assembly 170 to pivot the chamber 150, while its rim 250 remains fixed to the carriage 130. The gun's port side features bilaterally symmetric counterpart components. The bracket 210 has a length along the barrel axis of about 0.9 m, corresponding approximately to the diameter of the rim 250. Composed of steel, the bracket 210 and block 220 assembly has a mass of about $1.5\text{-}10^3$ kg.

Figure 3:
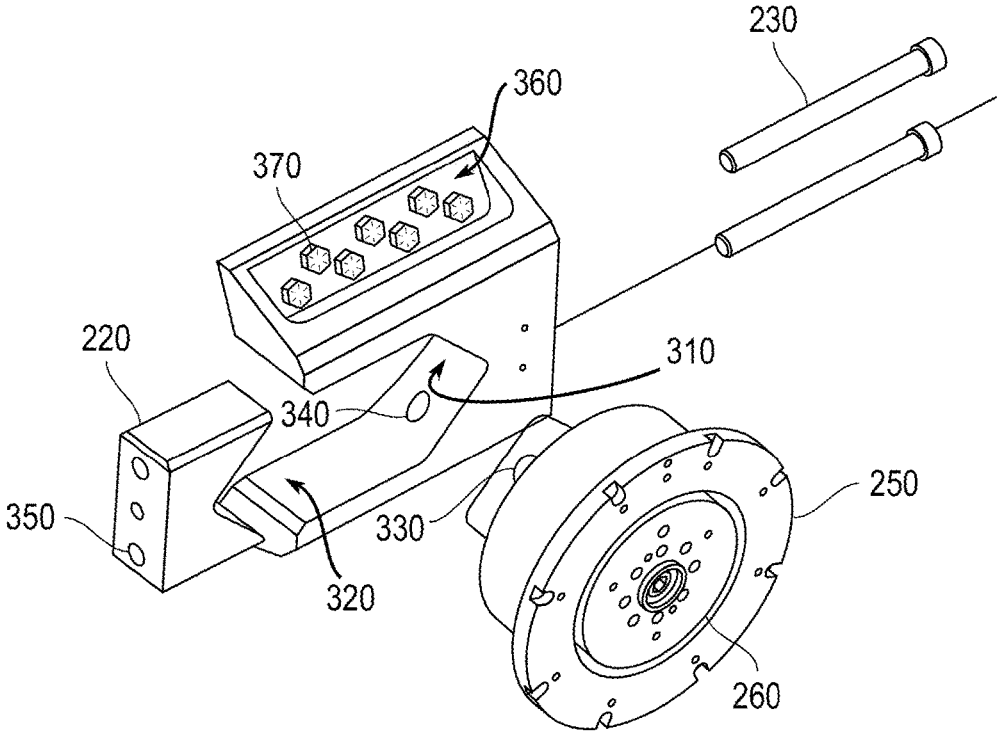
FIG. 3 is an isometric detail view of the mating components.

FIG. 3 shows an isometric detail exploded view 300 of components from view 200. The clevis bracket 210 includes a V-notch elongated recess 310. The tang block 220 includes a V-notch cutout notch 320. The V-notch shape resembles a rounded wedge. For a rectangular terminus 270, the edges of each V-notch would be perpendicular. The terminus 270 includes a pair of through-holes 330. The clevis bracket 210 includes a pair of through-holes 340. Similarly, the tang block 220 includes a corresponding pair of through-holes 350. Note that the recess 310 extends along a centerline parallel to the longitudinal axis of the chamber 150.

The bolts 230 pass consecutively through these holes 340, 330 and 350 to sandwich the rotor assembly 170 to the block assembly. On opposite sides of the recess 310, the clevis bracket 210 includes flat surfaces 360 on to which fasteners or auxiliary bolts 370 insert therethrough for securing the clevis bracket 210 to the chamber 150. In the configuration shown, seven bolts 370 are depicted on each surface 360, but this is exemplary and not limiting. Note that the surfaces 360 angularly flank the recess 310 and are substantially parallel to the tangents of the chamber 150.

Figure 4:
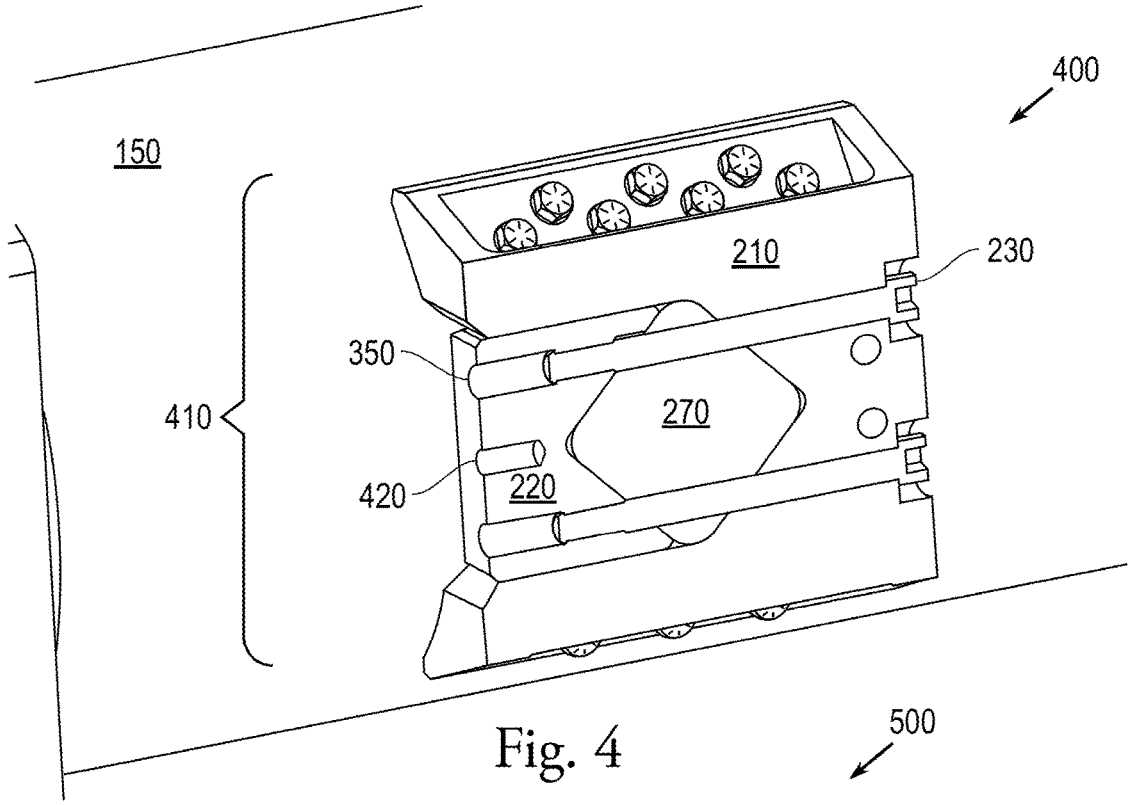
FIG. 4 is an isometric detail cutout view of the mating assembly.

FIG. 4 shows an isometric cutout detail view 400 of the mating assembly 410 through the plane of the bolts 230. The clevis bracket 210 attaches to the chamber 150 by bolts 370.

The terminus 270 wedges between the recess 310 of the clevis bracket 210 and the notch 320 of the tang block 220. The bolts 230 are shown inserted through the clevis bracket 210 and the terminus 270 and into the tang block 220, which also includes an access cavity 420, which is parallel to and between the holes 350. The bolts 370 are shown attaching the clevis bracket 210 at their surfaces 360 to the gun chamber 150.

Figure 5:
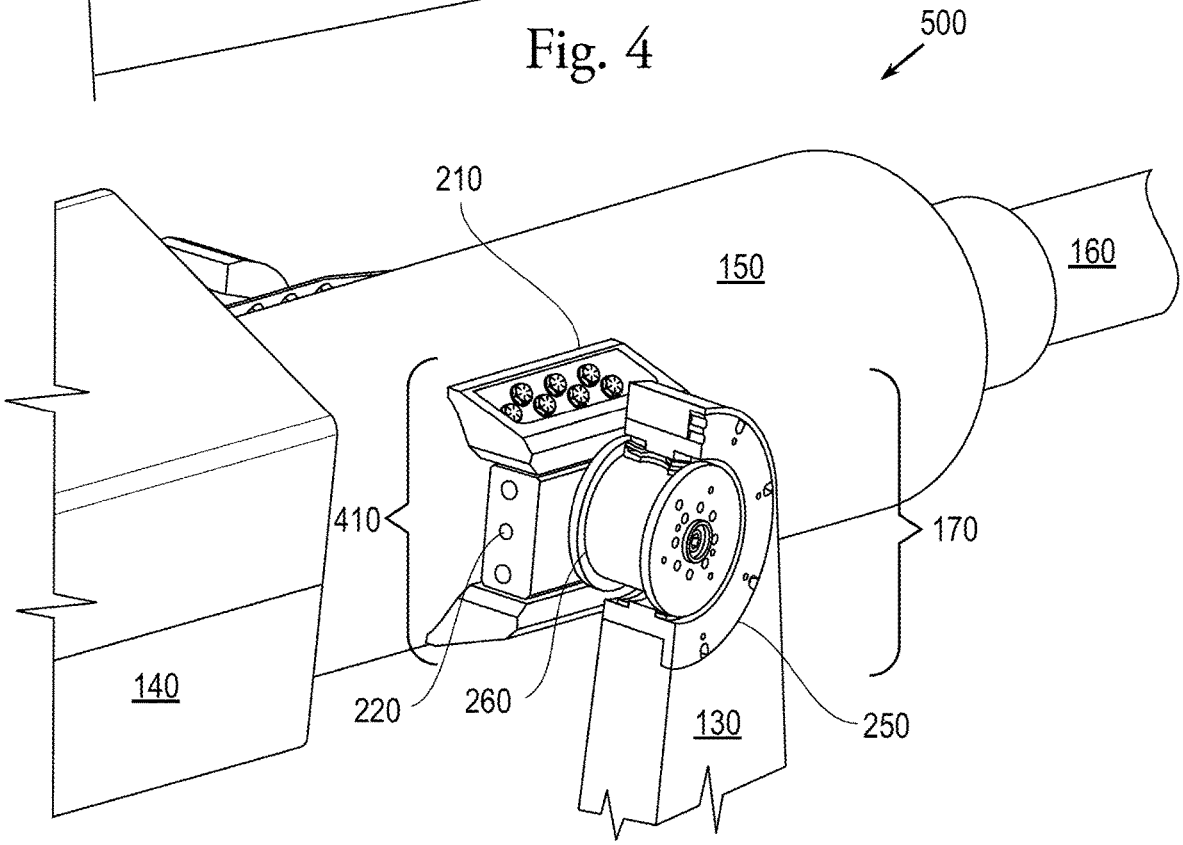
FIG. 5 is an isometric view of the mating assembly.

FIG. 5 shows an isometric view 500 of the mating assembly 410 associated with the rotor assembly 170 and the gun. The starboard yoke of the carriage 130 and the annular rim 250 are shown in cutaway view, while the shaft 260 is shown complete with the terminus 270 obscured by the mating assembly 410 mounted to the chamber 150. Attachments on the port side are bilaterally symmetric to the starboard side illustrated.

Exemplary embodiments provide a joint design for attaching a gun chamber 150 to a mating assembly 410 with a trunnion shaft 260. These embodiments are applicable to any gun mount system, but especially adapted to systems where the elevating torque transmits through the trunnion shaft 260. In the technical field of gun mounts, the rotor assembly 170 attaches to the carriage 130 in a common arrangement via pivoting bearing assemblies, sometimes referred to as trunnions in gunnery parlance.

A rotor assembly 170 contains a trunnion shaft 260 within an annular rim 250. The rotor assembly 170 can typically pitch up and down the barrel 160 in elevation via an external motor assembly (not shown) that provides torque. This may be in the form of an elevating rack, or an actuator. Exemplary embodiments were developed to fulfill a need to drive the rotor assembly 170 via the trunnion shaft 260. This introduces additional considerations not addressed via conventional designs. Specifically, the substantial driving torques and firing couple must be accounted for in a manner that is safe and permits a minimum of torsional deflection.

The trunnion shaft 260 is machined with a polygonal terminus 270—e.g., a rectangular cross-section. The rotor assembly 170 attaches to the chamber 150 via the clevis bracket 210. The clevis bracket 210 and the tang block 220 clamp the terminus 270 between their corresponding recess 310 and notch 320. The bracket 210, terminus 270 and block 220 are then secured together by the bolts 230 as a mating assembly 410, as shown in cross-section view 400. The block 220 tightly fits into the recess 310 of the bracket 210. To aid in disassembly, a threaded hole 420 is provided for easy removal.

The resulting installation procedure has three main steps. First, a crane hangs the rotor assembly 170 on the waiting trunnion shafts 260. Secondly, the block 220 is disposed into the recess 310 of the bracket 210. Third, the bolts 230 are tightened, which drives the bracket 210 tightly against the polygonal terminus 270 of the shaft 260. The mating design enables the rotor assembly 170 to be installed or removed without disturbing the trunnion assemblies. In the exemplary embodiments, this is a necessary capability as trunnions 170 are tightly piloted into the carriage 130, and disturbing them should be prevented.

The polygonal shaft terminus 270 is capable of carrying large loads compared to a round shaft of the same size. This is important for applications where both the drive torque transmits and the firing couple reacts through the shaft 260. The joint 410 achieves a self-centering effect as clearance is provided by the edge corners. This insures that the intended facing surfaces are fully seated by the tightening of the bolts 230. This also results in repeatable location and concentricity over the course of multiple removal and reassembly iterations.

Alternatives such as a flange with bolt circle are also possible. Such methods, without additional features, do not provide concentricity. A flange could be equipped with a pilot or a conical mating surface, but then axial translation of the rotor would be required for assembly and disassembly. This then forces removal of the trunnion shaft 260 from the annular rim 250. As the trunnions typically need precision alignment, such removal is undesired.

Another conventional alternative is to design the trunnions as pillow blocks, which then obviates the need for this joint. However, the advantages of piloted trunnion assemblies are lost as a tradeoff. Exemplary embodiments are applicable in any gun weapon system being offered. The exemplary joint 410 could also be used in industrial machinery, for example, to join rollers to support and drive assemblies.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An attachment mechanism for connecting a trunnion shaft to a pivoting platform, said mechanism comprising:

a bracket having a center recess and flanking surfaces parallel to the pivoting platform;

a block having a cutout notch;

a polygonal terminus on the trunnion shaft that inserts into a gap formed between said recess and said notch;

a pair of bolts for extending through said bracket and said terminus and inserting into said block via corresponding holes that pass through said bracket and said terminus and into said block; and a plurality of fasteners for attaching said bracket at the facing surfaces to the pivoting platform.

2. The mechanism according to claim 1, wherein said terminus has a rectangular cross-section.

3. The mechanism according to claim 2, wherein said recess and said notch have wedge shapes.

4. The mechanism according to claim 1, wherein said fasteners are auxiliary bolts.

5. The mechanism according to claim 1, wherein said block includes a cavity parallel to and between said holes into which said bolts insert.

* * * * *